US007609994B2

(12) United States Patent
Park et al.

(10) Patent No.: US 7,609,994 B2
(45) Date of Patent: Oct. 27, 2009

(54) IMAGE DEVELOPING APPARATUS AND IMAGE FORMING APPARATUS USING THE APPARATUS

(75) Inventors: Seung-chan Park, Hwaseong-si (KR); Myoung-su Baek, Suwon-si (KR); Soon-seok Kwon, Suwon-si (KR)

(73) Assignee: Samsung Electronics Co., Ltd., Suwon-si, Gyeonggi-do (KR)

( * ) Notice: Subject to any disclaimer, the term of this patent is extended or adjusted under 35 U.S.C. 154(b) by 0 days.

(21) Appl. No.: 12/081,641

(22) Filed: Apr. 18, 2008

(65) Prior Publication Data

US 2008/0232851 A1 Sep. 25, 2008

Related U.S. Application Data

(62) Division of application No. 11/439,254, filed on May 24, 2006, now Pat. No. 7,386,248.

(30) Foreign Application Priority Data

Nov. 22, 2005 (KR) ..... 10-2005-0112051

(51) Int. Cl.
*G03G 15/08* (2006.01)
*G03G 21/18* (2006.01)

(52) U.S. Cl. ..... 399/103; 399/98; 399/113

(58) Field of Classification Search ..... 399/98, 399/103, 105, 106, 113, 119, 120, 284
See application file for complete search history.

(56) References Cited

U.S. PATENT DOCUMENTS 4,338,880 A 7/1982 Tabuchi et al.
4,575,219 A * 3/1986 Tomita et al. ..... 399/103
4,690,540 A 9/1987 Manno
4,792,831 A 12/1988 Takeda et al.
4,882,605 A 11/1989 Sakamoto
5,044,313 A 9/1991 Yuge et al.
5,134,960 A 8/1992 Shirai (Continued)

FOREIGN PATENT DOCUMENTS

CN 87100328 9/1987

(Continued)

*Primary Examiner*—Sophia S Chen
(74) *Attorney, Agent, or Firm*—Roylance, Abrams, Berdo & Goodman, L.L.P.

(57) ABSTRACT

An image developing apparatus includes an upper case; a lower case disposed on a lower side of the upper case, and internally housing a developing agent, and having an opening. A photoconductive drum is disposed on the upper case for forming an electrostatic latent image on a surface thereof. A charging roller is disposed on one side of an outer circumference of the photoconductive drum for charging the photoconductive drum. A developing roller having one part is exposed through the opening of the lower case to cooperate with the photoconductive drum for developing the electrostatic latent image. A scattering preventing unit disposed between the photoconductive drum and the developing roller, to prevent scattering of the developing agent supplied by the developing roller. The scattering preventing unit includes a blocking curtain which covers a part of the opening and having one side in contact with the outer circumference of the photoconductive drum. A fixing bracket is provided for supporting the blocking curtain.

22 Claims, 5 Drawing Sheets

U.S. PATENT DOCUMENTS

| | | | | |
|---|---|---|---|---|
| 6,256,466 | B1 | 7/2001 | Ota et al. | |
| 7,027,754 | B2 | 4/2006 | Harada et al. | |
| 2003/0059228 | A1 | 3/2003 | Tatsumi | |
| 2004/0047648 | A1 * | 3/2004 | Saito et al. ..... | 399/113 X |

FOREIGN PATENT DOCUMENTS

| | | |
|---|---|---|
| JP | 62-211675 | 9/1987 |
| JP | 01-108579 | 4/1989 |
| JP | 04-324468 | 11/1992 |
| JP | 05-224515 | 9/1993 |
| JP | 5-341701 | 12/1993 |
| JP | 08-234568 | 9/1996 |
| JP | 10-198162 | 7/1998 |
| JP | 10-307474 | 11/1998 |
| JP | 2000-047482 | 2/2000 |
| JP | 2000-066506 | 3/2000 |
| JP | 2002-072677 | 3/2000 |
| JP | 2002-278287 | 9/2002 |
| KR | 167117 | 9/1998 |
| KR | 10-2005-0054400 | 6/2005 |
| KR | 10-2005-0076094 | 7/2005 |

* cited by examiner

IMAGE DEVELOPING APPARATUS AND IMAGE FORMING APPARATUS USING THE APPARATUS

CROSS-REFERENCE TO RELATED APPLICATIONS

This application is a divisional application of Ser. No. 11/439,254, filed May 24, 2006. This application also claims benefit under 35 U.S.C. § 119(a) of Korean Patent Application No. 2005-112051, filed Nov. 22, 2005, in the Korean Intellectual Property Office, the entire contents of which are incorporated herein by reference.

BACKGROUND OF THE INVENTION

1. Field of the Invention

The present invention relates to an image developing apparatus and to an image forming apparatus using the image developing apparatus. More particularly, the present invention relates to an image developing apparatus and to an image forming apparatus, which prevent contamination of a charging roller or blocking of a light path by scattered toner during the developing process.

2. Description of the Related Art

An electrophotograph image forming apparatus forms an image on a recording medium, by use of an electrophotograph image forming method. The electrophotograph image forming apparatus may be an electrophotograph duplicator, an electrophotograph printer (for example, a laser beam printer), a facsimile and a MFP (multifunction printer).

The electrophotograph image forming apparatus such as the above-mentioned printer forms an electrostatic latent image by selectively exposing a photoconductive drum that is charged by a charging unit. The electrostatic latent image is developed with a developing agent in a developing unit. The image developed by the developing agent is scanned on the recording medium to record the image.

The electrophotograph image forming apparatus uses a process cartridge. The process cartridge may integrate the abovementioned charging unit and developing unit, or a cleaning unit and a photoconductive drum into one cartridge. This makes the cartridge attachable and detachable with respect to the image forming apparatus. Alternatively, at least one of the charging unit, the developing unit and the cleaning unit, and one photoconductive drum are integrated into one cartridge, and made attachable and detachable with respect to the image forming apparatus.

FIG. 1 is a fragmentary sectional view of a developing unit of a conventional image forming apparatus.

Referring to FIG. 1, a developing unit 10 includes an upper case 11 and a lower case 13. The inside of the upper case 11 is formed with a charging roller 15 and a photoconductive drum 17. The charging roller 15 charges a surface of the photoconductive drum 17 at a predetermined voltage, and the charged surface of the charging roller 17 is exposed to light irradiated from a light scanning unit 19, for example, a laser beam to form an electrostatic latent image on the surface of the charging roller 17.

The rear side of the upper case 11 is formed with a light passage hole (not shown) so that the light irradiated from the light scanning unit 19 can pass through and scan the surface of the photoconductive drum 17.

The inside of the lower case 13 includes a developing roller 21 for supplying toner to the electrostatic latent image formed on the surface of the photoconductive drum 17 and developing the latent image as a visible image. One side of the developing roller 21 is formed with a supplying roller 22 supplying the developing roller 21 with a toner (T1). An upper side of the lower case 21 has a regulating blade 23 regulating a toner layer of the developing roller 21, and the regulating blade 23 is supported by a blade bracket 25.

The abovementioned developing unit 10 operates as follows. The surface of the photoconductive drum 17 is charged through the charging roller 15 at a predetermined voltage. If a predetermined light is irradiated from the light scanning unit 19 on the charged surface of the charging roller 17 in the charged state, the electrostatic latent image is formed in the surface of the photoconductive drum 17.

The rotating surface of the developing roller 21 is supplied with the toner layer through the supplying roller 22. The toner layer is formed with a uniform thickness by regulating the thickness using a regulating blade 23.

The toner attached to the surface of the developing roller 21 moves to the photoconductive drum 17 by potential differences, and is applied on the electrostatic latent image to form a toner image. The photoconductive drum 17 and the developing roller 21 are not in contact, and positioned to provide a predetermined gap (D) therebetween. The toner formed on the surface of the developing roller 21 jumps the gap (D) between the photoconductive drum 17 and the developing roller 21, and moves to the photoconductive drum 17.

As discussed above, the photoconductive drum 17 and the developing roller 21 are not in contact, so the toner is not perfectly transferred, and the toner may be scattered. The scattered toner may contaminate the charging roller 15 and influence charging, thereby causing a defective image problem.

The scattered toner is attached to the upper side of the regulating blade 25, the inside of the upper case 11 or the external surface of the upper side of the lower case 13, and blocks a path of light irradiated from the light scanning unit 19, thereby causing image problems.

SUMMARY OF THE INVENTION

An aspect of the present invention is to solve at least the above problems and/or disadvantages of the related art and to provide at least the advantages described below. Accordingly, an aspect of the present invention is to provide an image developing apparatus, which prevents image defects by preventing contamination of the charging roller or preventing the blocking of the light path caused by toner scattering.

An aspect of the present invention is to provide an image forming apparatus employed with the abovementioned image developing apparatus.

In order to achieve the above-described aspects of the present invention, an image developing apparatus is provided comprising: an upper case; a lower case disposed on a lower side of the upper case and internally housing a developing agent, and having an opening; a photoconductive drum disposed on the upper case for forming an electrostatic latent image on a surface thereof; a charging roller disposed on one side of an outer circumference of the photoconductive drum, for charging the photoconductive drum; a developing roller having one part exposed through the opening of the lower case to cooperate with the photoconductive drum for developing the electrostatic latent image; and a scattering preventing unit disposed between the photoconductive drum and the developing roller, to prevent scattering of the developing agent supplied by the developing roller.

The scattering preventing unit includes a blocking curtain which covers a part of the opening on one side in contact with the outer circumference of the photoconductive drum, and a fixing bracket which supports the blocking curtain.

The blocking curtain is formed of soft materials, for example, Urethane.

The blocking curtain includes a supporting portion supported on the fixing bracket, and a bending portion having one end of the supporting portion bent to contact with the photoconductive drum. The bending portion is bent along the rotation direction of the photoconductive drum. The bending portion is bent to correspond to the outer circumference of the photoconductive drum.

The fixing bracket is disposed towards the opening on an upper side of the lower case.

The fixing bracket is additionally included with a regulating blade for regulating a thickness of a developing agent layer formed on a surface of the developing roller.

The photoconductive drum and the developing roller are disposed with a predetermined gap therebetween. The developing agent is a 1-component nonmagnetic toner.

In order to achieve the above-described aspects of the present invention, an image developing apparatus is provided comprising: an image developing apparatus comprising: a photoconductive drum for forming an electrostatic latent image on surface thereof; a charging roller disposed on one side of the photoconductive drum for charging the photoconductive drum; a developing roller disposed on the other side of the photoconductive drum for supplying a developing agent to develop the electrostatic latent image; and a scattering preventing unit disposed between the photoconductive drum and the developing roller to prevent scattering of the developing agent supplied by the developing roller. The scattering preventing unit covers an upper side of the developing roller, and includes a blocking curtain whose one side is in contact with an outer circumference of the photoconductive drum, and a fixing bracket which supports the blocking curtain.

In order to achieve the above-described aspects of the present invention, there is provided an image developing apparatus is provided comprising: an image forming apparatus comprising: at least one developing unit; and a transferring unit disposed on one side of the developing unit to transfer a developing agent image developed through the developing unit on a recording medium. The developing unit comprises: an upper case; a lower case disposed on a lower side of the upper case and internally housing a developing agent and formed with an opening; a photoconductive drum disposed on the upper case for forming an electrostatic latent image on a surface of the photoconductive drum; a charging roller disposed on one side of the photoconductive drum for charging the photoconductive drum; a developing roller having one part is exposed through the opening of lower case to cooperate with the photoconductive drum, and developing the electrostatic latent image; and a scattering preventing unit disposed between the photoconductive drum and the developing roller to prevent scattering of the developing agent supplied by the developing roller.

The scattering preventing unit includes a blocking curtain which covers an upper side of the developing roller whose one side is in contact with an outer circumference of the photoconductive drum, and a fixing bracket which supports the blocking curtain.

The scattering preventing unit is made of soft materials, for example, Urethane.

The scattering preventing unit includes a supporting portion supported on the fixing bracket, and a bending portion having one end of the supporting portion for contacting with the photoconductive unit. The bending portion is bent along a rotation direction of the photoconductive drum. The bending portion is curved to correspond to the outer circumference of the photoconductive drum.

The fixing bracket is disposed towards the opening of the lower case on an upper side of the lower case.

The fixing bracket additionally includes a regulating blade for regulating a developing agent layer formed on a surface of the developing roller.

The photoconductive drum and the developing roller are spaced a predetermined gap. The developing agent is a 1-component nonmagnetic toner.

BRIEF DESCRIPTION OF THE DRAWING FIGURES

The above aspect and other features of the present invention will become more apparent by describing in detail exemplary embodiments thereof with reference to the attached drawing figures, wherein.

DETAILED DESCRIPTION OF THE EXEMPLARY EMBODIMENTS

Figure 1:
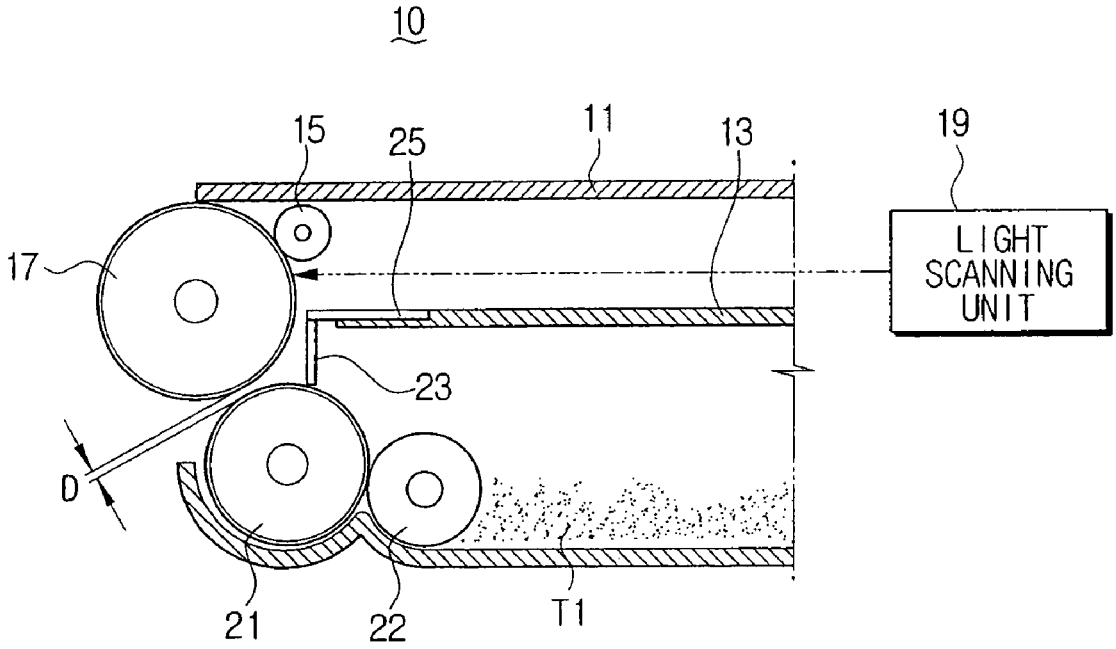
FIG. 1 (PRIOR ART)
FIG. 1 is a fragmentary sectional view of a developing unit of a conventional image forming apparatus.

Hereinafter, an embodiment of the present invention will be described in detail with reference to the accompanying drawing figures.

In the following description, same drawing reference numerals are used for the same elements even in different drawings. The matters defined in the description such as a detailed construction and elements are provided to assist in a comprehensive understanding of the invention. Thus, it is apparent that the present invention can be carried out without those defined matters. Also, well-known functions or constructions are not described in detail since they would obscure the invention in unnecessary detail.

Figure 2:
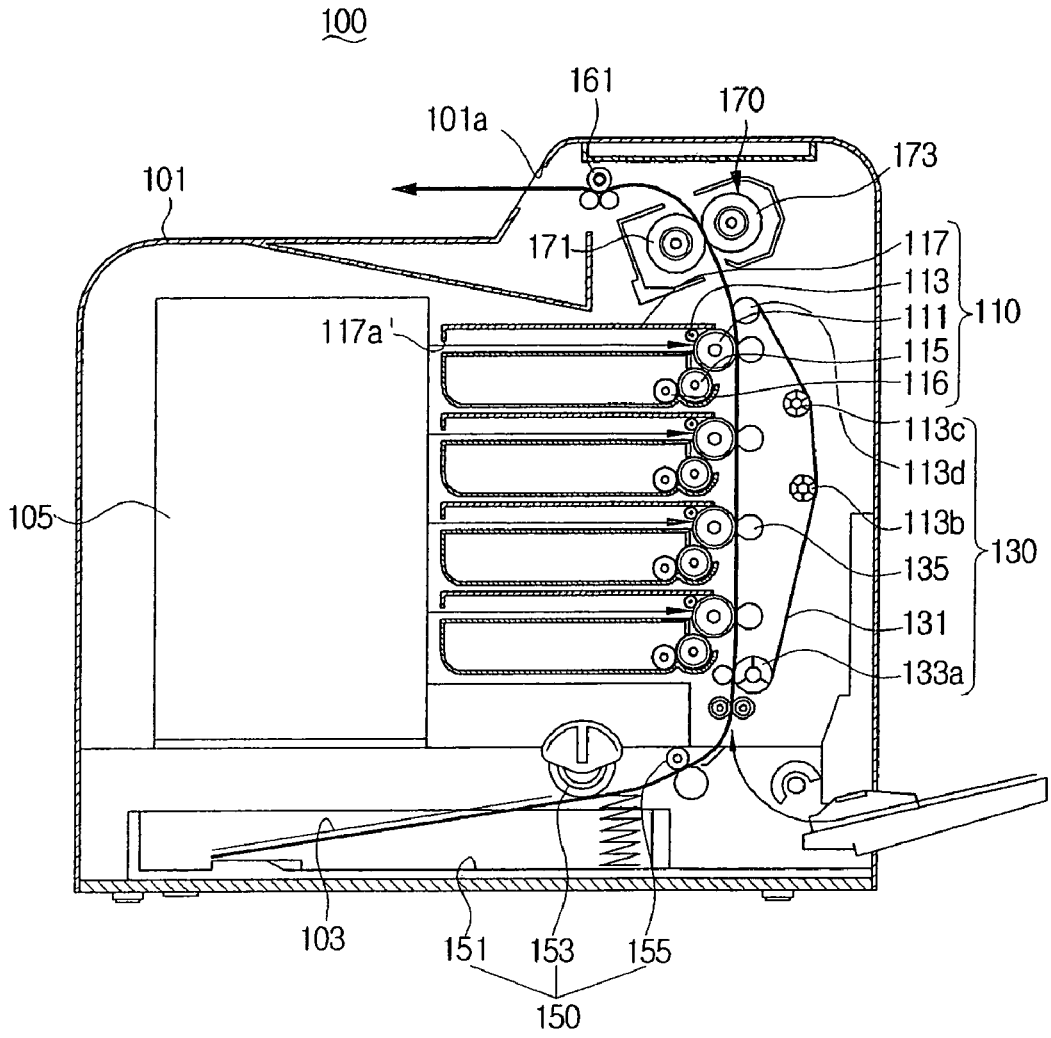
FIG. 2 is a side view of an image forming device according to an embodiment of the present invention.

FIG. 2 is a structural diagram of a complete image forming device 100 according to an embodiment of the present invention.

Referring to FIG. 2, the image forming apparatus includes a developing unit 110 for each of the four colors (black, cyan, magenta and yellow) inside a main body 101. The developing unit 110 includes a photoconductive drum 111, a charging roller 113, a developing roller 115, a supplying roller 116 and a developing agent case 117.

The photoconductive drum 111 has a surface charged at a uniform potential by the charging roller 113. Likewise, if a predetermined light, for example, from one or more laser beams, is scanned on the photoconductive drum 111 charged with a predetermined potential on the surface thereof, through a light scanning unit 105, an electrostatic latent image is formed on the photoconductive drum 111.

The electrostatic latent image formed on the photoconductive drum 111 is developed as a visible image by a developing agent being transferred by the developing roller 115.

A scanning unit 130 comprises a belt 131 driving on treads, in contact with the photoconductive drum 111, rollers 133*a* through 133*d* rotatably supporting the belt 131 and transferring rollers 135 installed inside the belt 131 to correspond to the photoconductive drum 111.

As above-mentioned, if the electrostatic latent image is developed as the visible image on the photoconductive drum 101 by the developing agent being supplied by the developing roller 115, a recording medium 103 is transferred by the belt 131 and the transferred recording medium 103 is scanned with a color image in duplicate, so that a perfect image is implemented.

A paper supplying unit 150 includes a supplying cassette 151 loaded with a plurality of pages or sheets of recording medium 103, a pickup roller 153 for picking up the recording medium 103 of the paper supplying cassette 151, and a feeding roller 155 for feeding the picked-up recording medium 103.

A fixing unit 170 applies heat and pressure on the recording medium 103 having passed through the belt 131 and the transferring rollers 135, and fixes the color image on the recording medium 103. The fixing unit 170 comprises a heating roller 171 and a pressurizing roller 173.

The recording medium 103 is transferred by an exit or discharge roller 161 out of the main body 101 through an exit port 101*a*.

Figure 3:
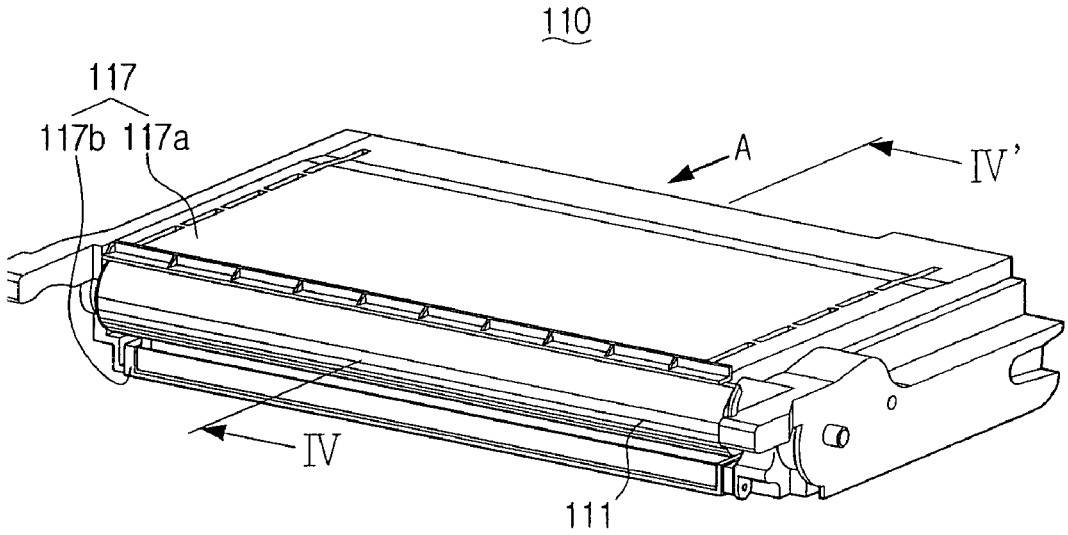
FIG. 3 is a perspective view of a developing unit structure according to the embodiment of the present invention.
Figure 4:
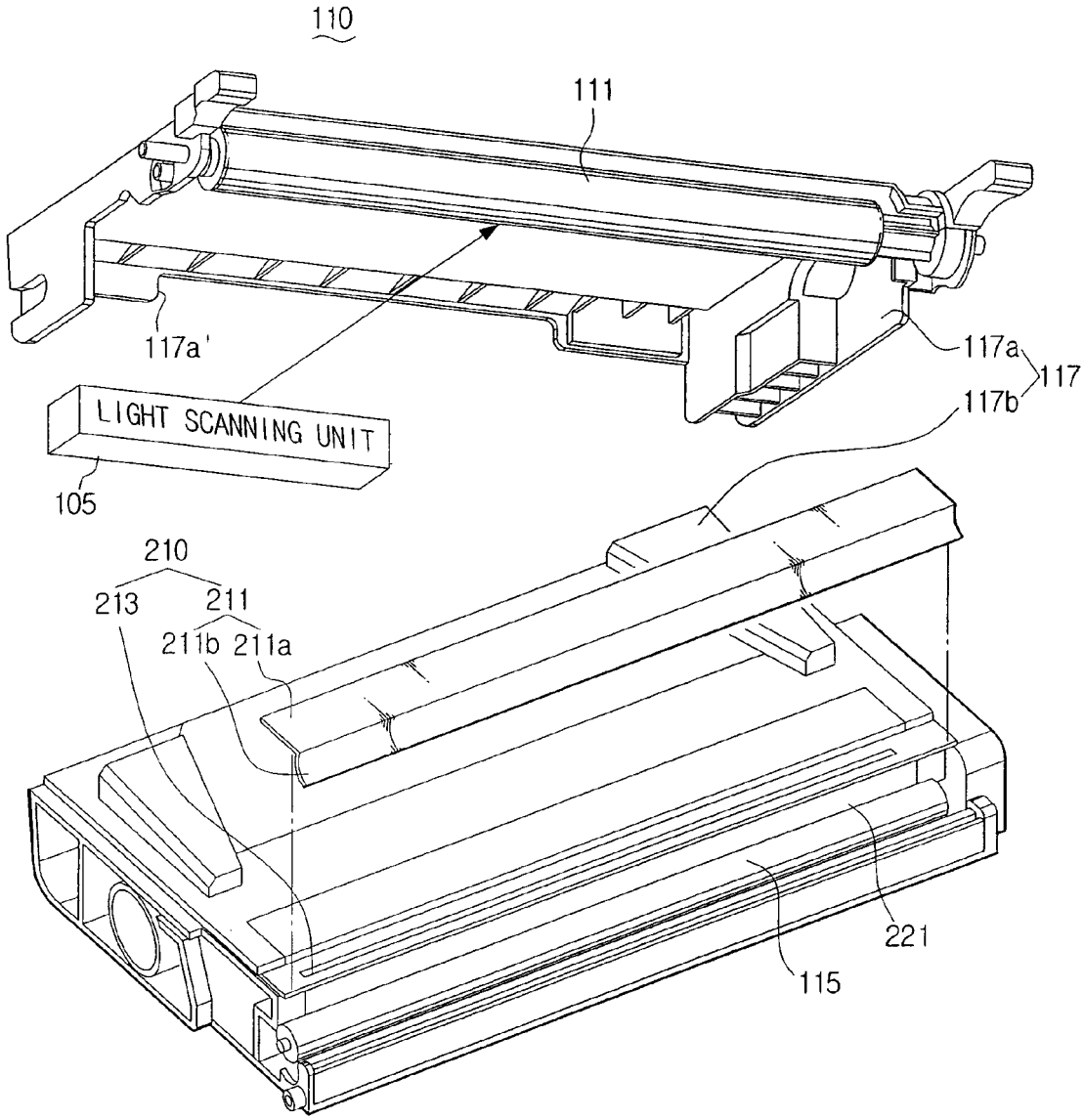
FIG. 4 is an exploded perspective view showing the photoconductive drum separated from the structure of FIG. 3.
Figure 5:
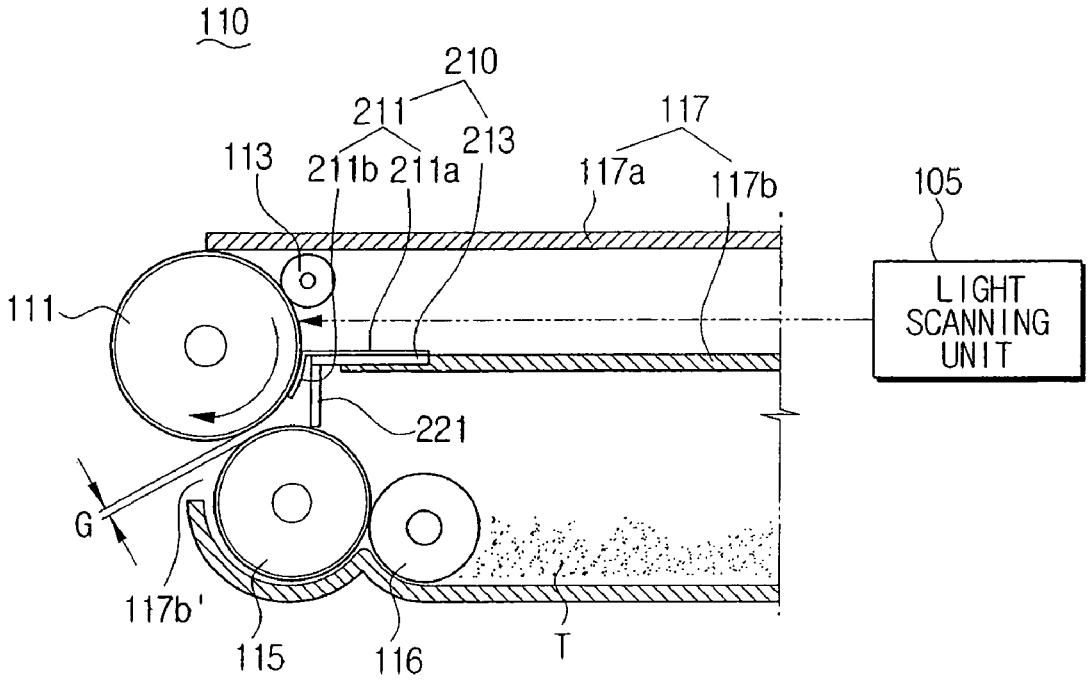
FIG. 5 is a view taken along IV-IV' of FIG. 3.

FIG. 3 is a perspective diagram of a developing unit structure according to the embodiment of the present invention, FIG. 5 is a perspective view showing a partially separated structure of FIG. 3 and FIG. 4 is a view taken along IV-IV' of FIG. 3.

Referring to FIGS. 3 through 5, a developing case forming an external appearance of the developing unit 110 comprises an upper case 117*a* and a lower case 117*b*. The upper case 117*a* is formed with the photoconductive drum 111 and the charging roller 113. A rear side A of the upper case 117*a* is formed with a light passage hole 117*a*' through which light irradiated from the light scanning unit 105 passes.

The lower case 117*b* internally houses a developing unit, for example, 1-component nonmagnetic toner (T), and an opening 117*b*' is formed at a side facing the photoconductive drum 111. Inside the lower case 117*b* is formed with a portion of an outer circumference of the developing roller 115 exposed through the opening 117*b*' as shown in FIG. 5. The developing roller 115 does not contact the photoconductive drum 111. The developing roller 115 and the photoconductive drum 111 are spaced apart by a predetermined gap (G). One side of the developing roller 115 is formed with the supplying roller 116 for supplying the toner (T) to the developing roller 115.

A scattering preventing unit 210 is formed with the upper side of the lower case 117*b* facing towards the opening 117*b*' as shown in FIG. 5. The scattering preventing unit 210 covers a part of the opening 117*b*' and includes a blocking curtain 211 whose one end is in contact with an outer circumference of the photoconductive drum 111, and a fixing bracket 213 supported on the upper side of the lower case 117*b* to support the blocking curtain 211.

The fixing bracket 213 is additionally formed with a regulating blade 221 for regulating a uniform thickness of a toner layer formed on the surface of the developing roller 115.

The blocking curtain 211 may be made of soft materials, for example, Urethane. The blocking curtain 211 includes a supporting portion 211*a* supported by the fixing bracket 213 and a bending portion 211*b* in contact with the outer circumference of the photoconductive drum 111. The bending portion 211*b* may be bent along the rotation direction of the photoconductive drum 111 (illustrated as a clockwise direction in FIG. 5) and be curved to correspond to the outer circumference of the photoconductive drum 111.

An operation of the above-structured developing unit will be described as below.

For example, approximately −700V bias supplying voltage and −600V bias supplying voltage are supplied to the supplying roller 116 and the developing roller 115, respectively. 100V voltage differences are maintained between the supplying roller 116 and the developing roller 115. If a toner supplying member (not shown) is driven in this state, the 1-component nonmagnetic toner (T) is supplied to the supplying roller 116.

The supplied toner (T) is attached to the surface of the supplying roller 116 and rotates together, to pass through a contact surface between the supplying roller 116 and the developing roller 115. The 1-component nonmagnetic toner (T) is charged by the medium of friction contact force between the supplying roller 116 and the developing roller 115. The charged toner moves towards the developing roller 115 from the supplying roller 116 within an electric field that is maintained at a uniform voltage difference. A toner layer is formed on the surface of the developing roller 115.

The toner layer formed on the surface of the developing roller 115 is maintained entirely at a uniform thickness by the regulating blade 221 and the rotation of the developing roller 115. That is, the surface of the developing roller 115 is formed with the uniform toner layer applied with the charged toner. The toner moves towards the photoconductive drum 111 by the voltage differences between the developing roller 115 and the photoconductive drum 111. The toners are applied on the electrostatic latent image and form the visible image. After that, the visible image is transferred to a recording medium by the high voltage scanning unit 130 (refer to FIG. 2).

In the above description, values of voltage supplied to each roller are one example provided to help easy explanation, and are not limited to the abovementioned voltage value.

While the development operation is performed, the toner (T) may be attached to the charging roller 113 and scattered inside the upper case 117*a* or the upper side of the fixing bracket 213. Charging problems may be caused or a light path may be blocked, to trigger image defects. The scattering preventing unit 210 of the present invention is provided to reduce or prevent the above-mentioned problem.

That is, a part of opening 117*b*' of the lower case 117*b* is blocked by the blocking curtain 211, so that scattering of the toner (T) is prevented. The blocking curtain 211 is bent along the rotation direction of the photoconductive drum 111, without disturbing the rotation of the photoconductive drum 111. The blocking curtain 211 is made of a soft material such as Urethane, so that it does not damage the photoconductive drum 111, such as by scratching, even when in contact therewith.

As mentioned above, an embodiment of the present invention efficiently prevents triggering of the effects that cause image defects, by solving problems of contaminating a charging roller or blocking a light path caused by toner scattering.

While the invention has been shown and described with reference to certain embodiments thereof, it will be understood by those skilled in the art that various changes in form and details may be made therein without departing from the spirit and scope of the invention as defined by the appended claims.

What is claimed is:

1. An image developing apparatus comprising:

an upper case;

a lower case disposed on and fixed to a lower side of the upper case, and internally housing a developing agent, and having an opening;

a photoconductive drum disposed on the upper case for forming an electrostatic latent image on a surface thereof;

a charging roller disposed on one side of an outer circumference of the photoconductive drum, for charging the photoconductive drum;

a developing roller having one part exposed through the opening of the lower case to cooperate with the photoconductive drum, and developing the electrostatic latent image;

a fixing bracket coupled to an upper side of the lower case and supporting a regulating blade which regulates a thickness of a developing agent layer formed on a surface of the developing roller; and a scattering preventing unit disposed between the photoconductive drum and the developing roller, to prevent scattering of the developing agent supplied by the developing roller, the scattering preventing unit including a blocking curtain covering a part of the opening and having one side in contact with the outer circumference of the photoconductive drum and the fixing bracket supporting the other side of the blocking curtain, the blocking curtain including a supporting portion supported on the fixing bracket, and a bending portion having one end of the supporting portion bent to contact the photoconductive drum;

wherein one end of the scattering preventing unit is attached to a top surface of the fixing bracket and the other end of the scattering preventing unit is disposed toward the photoconductive drum.

2. The image developing apparatus of claim 1, wherein the blocking curtain is formed of soft materials.

3. The image developing apparatus of claim 2, wherein the blocking curtain is formed of Urethane.

4. The image developing apparatus of claim 1, wherein the bending portion is bent along the rotation direction of the photoconductive drum.

5. The image developing apparatus of claim 4, wherein the bending portion is bent to correspond to the outer circumference of the photoconductive drum.

6. The image developing apparatus of claim 1, wherein the fixing bracket is disposed towards the opening.

7. The image developing apparatus of claim 1, wherein the supporting portion of the blocking curtain is coupled to the top surface of the fixing bracket and where the bending portion has a substantially concave inner surface contacting the photoconductive drum and a substantially convex outer surface facing said regulating blade.

8. The image developing apparatus of claim 1, wherein the developing agent is a 1-component nonmagnetic toner.

9. An image developing apparatus, comprising:

an upper case;

a lower case disposed on and fixed to a lower side of the upper case, and internally housing a developing agent, and having an opening;

a photoconductive drum disposed on the upper case for forming an electrostatic latent image on a surface thereof;

a charging roller disposed on one side of an outer circumference of the photoconductive drum, for charging the photoconductive drum;

a developing roller having one part exposed through the opening of the lower case to cooperate with the photoconductive drum, and developing the electrostatic latent image, wherein the photoconductive drum and the developing roller are disposed away at a predetermined gap therebetween;

a fixing bracket coupled to an upper side of the lower case and supporting a regulating blade which regulates a thickness of a developing agent layer formed on a surface of the developing roller; and a scattering preventing unit disposed between the photoconductive drum and the developing roller, to prevent scattering of the developing agent supplied by the developing roller, wherein one end of the scattering preventing unit is attached to a top surface of the fixing bracket and the other end of the scattering preventing unit is disposed toward the photoconductive drum.

10. An image developing apparatus comprising:

an upper case;

a lower case disposed on a lower side of the upper case, and internally housing a developing agent, and having an opening;

a photoconductive drum forming an electrostatic latent image on a surface thereof;

a charging roller disposed on one side of the photoconductive drum for charging the photoconductive drum;

a developing roller disposed on the other side of the photoconductive drum for supplying a developing agent to develop the electrostatic latent image, the photoconductive drum and the developing roller being disposed away from each other to define a predetermined gap therebetween; and a scattering preventing unit disposed between the photoconductive drum and the developing roller to prevent scattering of the developing agent supplied by the developing roller, wherein the scattering preventing unit covers an upper side of the developing roller, and includes a blocking curtain having one side in contact with an outer circumference of the photoconductive drum, and a fixing bracket supporting the other side of the blocking curtain, wherein the fixing bracket is supported on the upper side of the lower case and supports a regulating blade which regulates a thickness of a developing agent layer formed on the surface of the developing roller, wherein the regulating blade is positioned between the scattering preventing unit and the developing agent contained in the lower case.

11. An image forming apparatus comprising:

at least one developing unit; and a transferring unit disposed on one side of the developing unit to transfer a developing agent image developed through the developing unit on a recording medium, wherein the developing unit comprises:

an upper case;

a lower case disposed on a lower side of the upper case, and internally housing a developing agent and formed with an opening;

a photoconductive drum disposed on the upper case to form an electrostatic latent image on a surface of the photoconductive drum;

a charging roller disposed on one side of the photoconductive drum to charge the photoconductive drum;

a developing roller having one part exposed through the opening of the lower case to cooperate with the photoconductive drum, and for developing the electrostatic latent image;

a fixing bracket supported on the upper side of the lower case and supporting a regulating blade which regulates a thickness of a developing agent layer formed on the surface of the developing roller; and a scattering preventing unit disposed between the photoconductive drum and the developing roller to prevent scattering of the developing agent supplied by the developing roller, the scattering preventing unit including a blocking curtain covering an upper side of the developing roller and having one side in contact with an outer circumference of the photoconductive drum and the fixing bracket supporting the other side of the blocking curtain, the scattering preventing unit including a supporting portion supported on the fixing bracket, and a bending portion having one end of the supporting portion in contact with the photoconductive drum, wherein one end of the scattering preventing unit is attached to the fixing bracket and the other end of the scattering preventing unit is disposed toward the photoconductive drum.

12. The image forming apparatus of claim 11, wherein the scattering preventing unit is made of soft materials.

13. The image forming apparatus of claim 12, wherein the scattering preventing unit is made of Urethane.

14. The image forming apparatus of claim 11, wherein the bending portion is bent along a rotation direction of the photoconductive drum.

15. The image forming apparatus of claim 11, wherein the bending portion is curved to correspond to the outer circumference of the photoconductive drum.

16. The image forming apparatus of claim 11, wherein the fixing bracket is disposed towards the opening of the lower case.

17. The image forming apparatus of claim 11, wherein the scattering preventing unit is positioned between the regulating blade and the photoconductive drum.

18. The image forming apparatus of claim 11, wherein the fixing bracket has a top surface and a bottom surface, with the bottom surface being coupled to a top surface of the lower case, the regulating blade being coupled to a bottom side of the fixing bracket, and where the scattering preventing unit has a first end coupled to a top surface of the fixing bracket, and a curved second end contacting the photoconductive drum and extending substantially adjacent the regulating blade.

19. The image developing apparatus of claim 11, wherein the developing agent is a 1-component nonmagnetic toner.

20. An image forming apparatus, comprising:

at least one developing unit; and a transferring unit disposed on one side of the developing unit to transfer a developing agent image developed through the developing unit on a recording medium, wherein the developing unit comprises:

an upper case;

a lower case disposed on a lower side of the upper case, and internally housing a developing agent and formed with an opening;

a photoconductive drum disposed on the upper case to form an electrostatic latent image on a surface of the photoconductive drum;

a charging roller disposed on one side of the photoconductive drum to charge the photoconductive drum;

a developing roller having one part exposed through the opening of the lower case to cooperate with the photoconductive drum, and for developing the electrostatic latent image, wherein the photoconductive drum and the developing roller are spaced a predetermined gap;

a fixing bracket supported on the upper side of the lower case and supporting a regulating blade which regulates a thickness of a developing agent layer formed on the surface of the developing roller; and a scattering preventing unit disposed between the photoconductive drum and the developing roller to prevent scattering of the developing agent supplied by the developing roller, wherein one end of the scattering preventing unit is attached to the fixing bracket and the other end of the scattering preventing unit is disposed toward the photoconductive drum.

21. An image developing apparatus comprising:

an upper case;

a lower case disposed on a lower side of the upper case, and internally housing a developing agent, and having an opening;

a photoconductive drum disposed on the upper case for forming an electrostatic latent image on a surface thereof;

a charging roller disposed on one side of an outer circumference of the photoconductive drum, for charging the photoconductive drum;

a developing roller having one part exposed through the opening of the lower case to cooperate with the photoconductive drum, and developing the electrostatic latent image, the photoconductive drum and the developing roller being spaced apart to define a predetermined gap therebetween;

a fixing bracket supporting a regulating blade which contacts with the developing roller to regulate a thickness of a developing agent layer formed on a surface of the developing roller; and a scattering preventing unit coupled to the fixing bracket and being disposed between the photoconductive drum and the developing roller, to prevent scattering of the developing agent supplied by the developing roller.

22. An image forming apparatus comprising:

at least one developing unit; and a transferring unit disposed on one side of the developing unit to transfer a developing agent image developed through the developing unit on a recording medium, wherein the developing unit comprises:

an upper case;

a lower case disposed on a lower side of the upper case, and internally housing a developing agent and formed with an opening;

a photoconductive drum disposed on the upper case to form an electrostatic latent image on a surface of the photoconductive drum;

a charging roller disposed on one side of the photoconductive drum to charge the photoconductive drum;

a developing roller having one part exposed through the opening of the lower case to cooperate with the photoconductive drum, and for developing the electrostatic latent image, the photoconductive drum and the developing roller being spaced apart to define a predetermined gap therebetween;

a fixing bracket supporting a regulating blade which contacts with the developing roller to regulate a thickness of a developing agent layer formed on the surface of the developing roller; and a scattering preventing unit on the fixing bracket and disposed between the photoconductive drum and the developing roller to prevent scattering of the developing agent supplied by the developing roller.

* * * * *